US005388506A

United States Patent [19]

Vargas et al.

[11] Patent Number: 5,388,506

[45] Date of Patent: Feb. 14, 1995

[54] NEWSPAPER RECYCLING HOLDER

[76] Inventors: Augustin Vargas, 144 Seaman Ave. #1F, New York, N.Y. 10034; George Spector, 233 Broadway Rm. 702, New York, N.Y. 10279

[21] Appl. No.: 240,453

[22] Filed: May 10, 1994

[51] Int. Cl.[6] ..... B65B 13/18

[52] U.S. Cl. ..... 100/34; 211/50

[58] Field of Search ..... 100/1, 34; 211/50

[56] References Cited

U.S. PATENT DOCUMENTS

| | | | |
|---|---|---|---|
| D. 230,802 | 3/1974 | Morita | 100/34 X |
| 2,599,290 | 6/1952 | Schwenzer | 100/34 X |
| 2,637,268 | 5/1953 | Culver | 100/34 X |
| 3,038,403 | 6/1962 | Orelind | 100/34 |
| 3,171,347 | 3/1965 | Elrod | 100/34 X |
| 4,934,262 | 6/1990 | Turi et al. | 100/34 |
| 5,072,576 | 12/1991 | Evans | 100/34 X |

*Primary Examiner*—Stephen F. Gerrity

[57] ABSTRACT

A newspaper recycling holder is provided, which consists of a base to sit upon a flat surface. An open top receptacle has a bottom platform, a pair of end walls and a pair of side walls to retain a stack of newspapers therein. The receptacle further has a longitudinal central slot extending through the bottom platform and the end walls. An intersecting transverse central slot extends through the bottom platform and the side walls. Components are for elevating the receptacle above the base, so as to provide a space between the base and the bottom platform. A supply of twine is to be wound and tied about the stack of newspapers through the slots in the receptacle, so that the bound stack of newspapers can be collected for disposal and recycling.

5 Claims, 1 Drawing Sheet

NEWSPAPER RECYCLING HOLDER

BACKGROUND OF THE INVENTION

The instant invention relates generally to devices for bundling sheet material and more specifically it relates to a newspaper recycling holder, which provides a structure for storing newspaper that can be bound for disposal.

There are available various conventional devices for bundling sheet material which do not provide the novel improvements of the invention herein disclosed.

SUMMARY OF THE INVENTION

A primary object of the present invention is to provide a newspaper recycling holder that will overcome the shortcomings of the prior art devices.

Another object is to provide a newspaper recycling holder that permits a convenient storing of loose newspapers, so that the newspapers can be bound with twine and then collected for disposal and recycling.

An additional object is to provide a newspaper recycling holder that is height and width adjustable, so that the holder can retain newspapers of different sizes therein.

A further object is to provide a newspaper recycling holder that is simple and easy to use allowing hands to move freely under newspaper stack.

A still further object is to provide a newspaper recycling holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
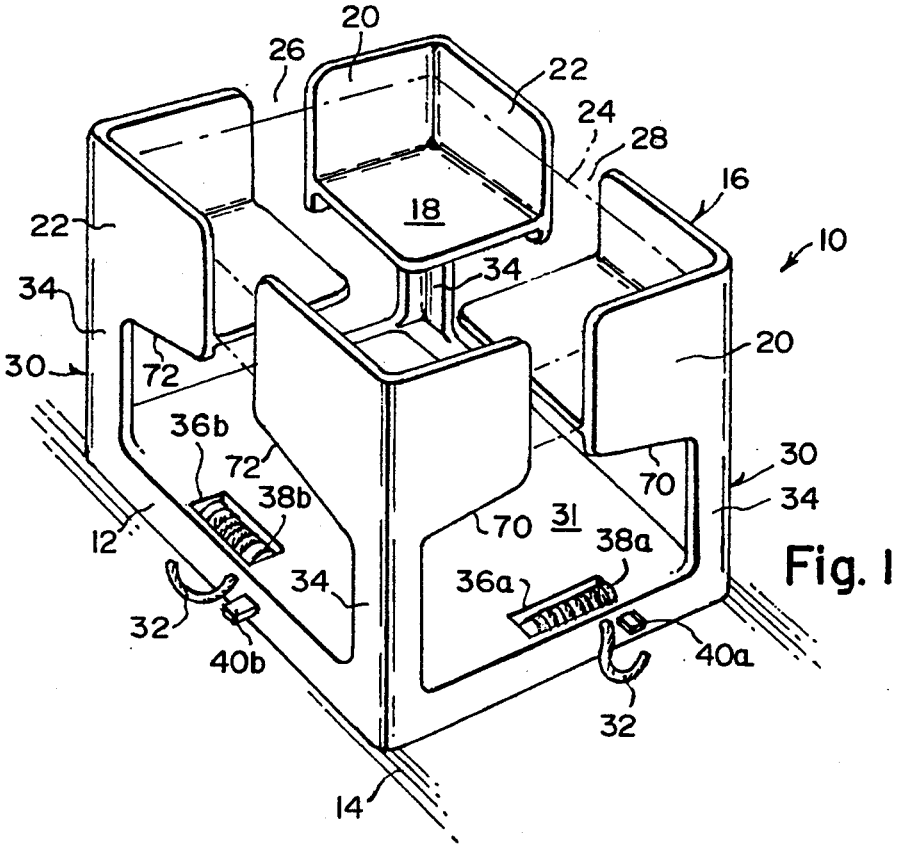
FIG. 1 is a perspective view of the instant invention.

Turning now descriptively to the drawings, in which similar reference characters denote similar elements throughout the several views, FIG. 1 illustrates a newspaper recycling holder 10, which consists of a base 12 to sit upon a flat surface 14. An open top receptacle 16 has a bottom platform 18, a pair of end walls 20 and a pair of side walls 22 to retain a stack of newspapers 24 therein. The receptacle 16 further has a longitudinal central slot 26 extending through the bottom platform 18 and the end walls 20. An intersecting transverse central slot 28 extends through the bottom platform 18 and the side walls 22. Components 30 are for elevating the receptacle 16 above the base 12, so as to provide a space 31 between the base 12 and the bottom platform 18. A supply of twine 32 is to be wound and tied about the stack of newspapers 24 through the slots 26, 28 in the receptacle 16, so that the bound stack of newspapers 24 can be collected for disposal and recycling. The elevating components 30 are four posts 34, each extending vertically between one corner of the base 12 and one corner of the receptacle 16.

A first twine dispenser **36*a* is provided, having a first spool 38*a* with some of the twine 32 thereon. The first twine dispenser 36*a* is recessed into the base 12 directly under one end wall 20 of the receptacle 16. A first twine cutter 40*a* is mounted to one end of the base 12 at the first twine dispenser 36*a*. A second twine dispenser 36*b* has a second spool 38*b* with some of the twine 32 thereon. The second twine dispenser 36*b* is recessed into the base 12 directly under one side wall 22 of the receptacle 16. A second twine cutter 40*b* is mounted to one side of the base 12 at the second twine dispenser 36*b***.

Figure 2:
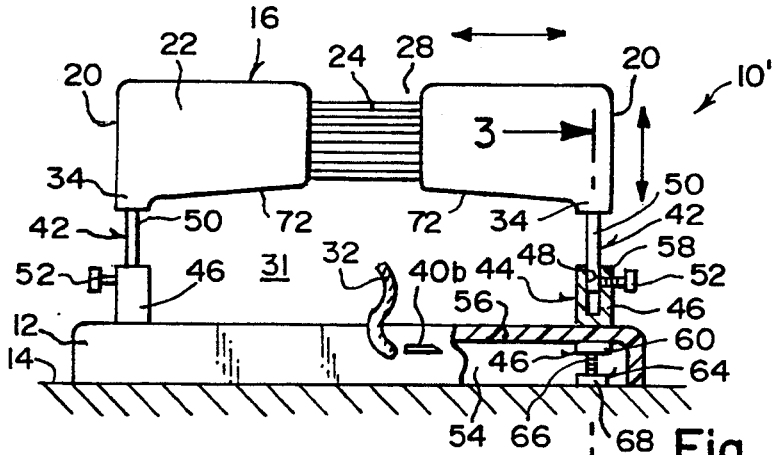
FIG. 2 is an elevational view with parts broken away, showing a modification in which the holder is height and width adjustable.
Figure 3:
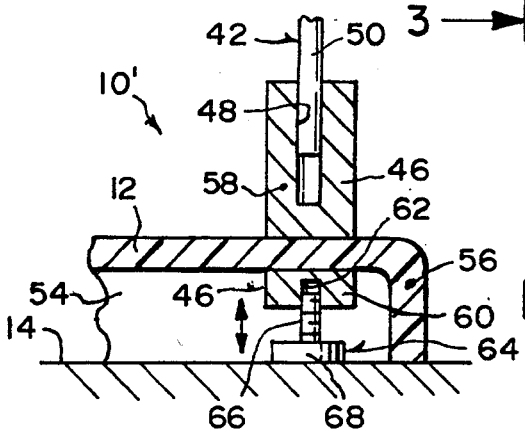
FIG. 3 is an enlarged cross sectional view taken along line 3—3 in FIG. 2, showing the magnet with the adjustment screw in greater detail.

A second embodiment newspaper recycling holder 10' is shown in FIGS. 2 and 3 and further contains structures 42 for adjusting the height of the holder 16. Elements 44 are for adjusting the width of the holder 16, so as to retain a stack of newspapers 24 of different sizes therein.

The height adjusting structures 42, consist of each post 34 containing a foot 46 that has a vertical bore 48 extending inwardly from a top end. A telescopic leg 50 extends vertically downwardly from one corner of the receptacle 16, to slideably fit into the vertical bore 48 of the foot 46. A set screw 52 extends transversely into the foot 46, to engage with the telescopic leg 50.

The width adjusting elements 44 includes the base 12 having a recessed open bottom 54 and is fabricated out of a non-magnetic material 56. Each foot 46 is fabricated out of magnetic material 58. Four magnets 60 are provided, with each to be placed within the recessed open bottom against the base 12 directly under one foot 46, so as to hold the foot 46 on the base 12 and be width adjusted thereto.

The width adjusting elements 44 further contain each magnet 60 having a bottom threaded aperture 62. Four adjustment screws 64 are provided, with each having a threaded shank 66 and a head 68. Each threaded shank 66 can thread into each threaded aperture 62 in one magnet 60. The head 68 can contact the flat surface 14, to make sure that the magnet 60 is always against the base 12 within the recessed open bottom 54, even if the foot 46 is removed from the base 12.

Inclined bottom edges 70 and 72 of the end walls 20 and side wall 22 extend below the level of the bottom platform 18. The inclined bottom edges 70 and 72 will easily guide the twine 32 towards the slots 26 and 28. The end walls 20 and the side walls 22 cover all sides of the stack of newspapers 24 that are to be bound.

OPERATION OF THE INVENTION

To use the newspaper recycling holder 10 in FIG. 1, a person simply stacks newspapers 24 within the receptacle 16 until full. A length of twine 32 from the first spool **38*a* can be unrolled from the dispenser 36*a* and cut on the cutter 40*a*. The twine 32, can then be tied about the newspapers 24 through the slot 26. A length of twine 32 from the second spool 38*b* can be unrolled from the dispenser 36*b* and cut on the cutter 40*b*. The twine 32 can then be tied about the newspapers 24 through the slot 28**.

To use the newspaper recycling holder 10' in FIGS. 2 and 3, a person can follow all the steps as indicated above. To adjust the height each telescopic leg 50 can slide within each vertical bore 48 in each foot 46 to a proper setting and then be retained thereto by tightening each set screw 52. To adjust the width the magnets 60 can be positioned within the base 12, with the heads 68 of the adjustment screws 64 contacting the flat surface 14, thereby holding the magnet feet 46 stationary on the base 12, by the magnets 60.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A newspaper recycling holder which comprises:

a) a base to sit upon a flat surface;

b) an open top receptacle extending vertically from said base having a bottom platform, a pair of end walls and a pair of side walls to retain a stack of newspapers therein, said receptacle further having a longitudinal central slot extending through said bottom platform and said end walls and an intersecting transverse central slot extending through said bottom platform and said side walls;

c) means mounted on said base for elevating said receptacle above said base, so as to provide a space between said base and said bottom platform for convenient movement of the users hands;

d) a supply of twine mounted on said base to be wound and tied about the stack of newspapers through said slots in said receptacle, so that the bound stack of newspapers can be collected for disposal and recycling; wherein said base has four corners and said elevating means includes four posts, each extending vertically from each said corner; further including:

e) a first twine dispenser having a first spool of twine, wherein said first twine dispenser is recessed into said base directly under one said end wall of said receptacle;

f) a first twine cutter mounted to one end of said base at said first twine dispenser;

g) a second twine dispenser having a second spool of twine, wherein said second twine dispenser is recessed into said base directly under one said side wall of said receptacle; and h) a second twine cutter mounted to one side of said base at said second twine dispenser.

2. A newspaper recycling holder as recited in claim 1 further including:

a) means for adjusting the height of said receptacle; and b) means for adjusting the width of said receptacle so as to retain a stack of newspapers of different sizes therein.

3. A newspaper recycling holder as recited in claim 2, wherein said height adjusting means includes each said post containing:

a) a foot having a vertical bore extending inwardly from a top end;

b) a telescopic leg extending vertically downwardly from one corner of said receptacle to slideably fit into said vertical bore of said foot; and c) a set screw extending transversely into said foot to engage with said telescopic leg.

4. A newspaper recycling holder as recited in claim 3, wherein said width adjusting means includes:

a) said base having a recessed open bottom and fabricated out of a non-magnetic material;

b) each said foot fabricated out of magnetic material; and c) four magnets, each to be placed within said recessed open bottom against said base directly under one said foot, so as to hold said foot on said base and be width adjusted thereto.

5. A newspaper recycling holder as recited in claim 4, wherein said width adjusting means further includes:

a) each said magnet having a bottom threaded aperture;

b) four adjustment screws, each having a threaded shank and a head, whereby each said threaded shank can thread into each said threaded aperture in one said magnet, while said head can contact the flat surface to make sure that said magnet is always against said base within said recessed open bottom, even if said foot is removed from said base; and c) said end and side walls further having inclined bottom edges extending below level of bottom platform.

* * * * *